US007965818B2

(12) United States Patent
Jaafar et al.

(10) Patent No.: US 7,965,818 B2
(45) Date of Patent: Jun. 21, 2011

(54) FIELD EMISSION X-RAY APPARATUS, METHODS, AND SYSTEMS

(75) Inventors: Ali Jaafar, Eden Prairie, MN (US); Victor I. Chornenky, Minnetonka, MN (US)

(73) Assignee: Minnesota Medical Physics LLC, Edina, MN (US)

( * ) Notice: Subject to any disclaimer, the term of this patent is extended or adjusted under 35 U.S.C. 154(b) by 96 days.

(21) Appl. No.: 12/337,290

(22) Filed: Dec. 17, 2008

(65) Prior Publication Data

US 2010/0002840 A1 Jan. 7, 2010

Related U.S. Application Data

(60) Provisional application No. 61/133,582, filed on Jul. 1, 2008.

(51) Int. Cl.
*H01J 35/02* (2006.01)
*H01J 35/06* (2006.01)
*H01J 35/14* (2006.01)

(52) U.S. Cl. ..... 378/122; 378/121; 378/135; 378/136; 378/137

(58) Field of Classification Search ..... 378/64, 378/65, 121, 122, 198, 135, 136, 137, 138
See application file for complete search history.

(56) References Cited

U.S. PATENT DOCUMENTS 3,303,372 A * 2/1967 Gager ..... 378/122
5,153,900 A * 10/1992 Nomikos et al. ..... 378/65
5,165,093 A 11/1992 Miller et al.
5,428,658 A 6/1995 Oettinger et al.
RE35,383 E 11/1996 Miller et al.
5,729,583 A 3/1998 Tang et al.
5,854,822 A * 12/1998 Chornenky et al. ..... 378/122
6,055,294 A * 4/2000 Foerst et al. ..... 378/138
6,108,402 A * 8/2000 Chornenky ..... 378/119
6,134,300 A * 10/2000 Trebes et al. ..... 378/136
6,148,061 A * 11/2000 Shefer et al. ..... 378/121
6,289,079 B1 * 9/2001 Chornenky et al. ..... 378/143
6,319,188 B1 * 11/2001 Lovoi ..... 600/3
6,324,257 B1 * 11/2001 Halavee ..... 378/121
6,353,658 B1 * 3/2002 Trebes et al. ..... 378/123
6,381,305 B1 * 4/2002 Okada et al. ..... 378/137
6,415,016 B1 * 7/2002 Chornenky et al. ..... 378/122

(Continued)

OTHER PUBLICATIONS

John D. Jackson, Classical Electrodynamics, second edition, (John Wiley & Sons, 1975), pp. 296-298.*
Christophe Valmaggia et al., Abstract for "Age-related macular degeneration: long-term results of radiotherapy for subfoveal neovascular membranes", PubMed for Am J Ophthalmol., vol. 130, Issue 5, Nov. 2000, 1 page.

(Continued)

*Primary Examiner* — Allen C. Ho
(74) *Attorney, Agent, or Firm* — Skaar Ulbrich Macari, P.A.

(57) ABSTRACT

Disclosed herein is an x-ray field emission apparatus, system and method, the apparatus having a hollow probe held at vacuum; a cathode enclosed within the probe, the cathode producing an electron stream when connected to a high negative potential; an anode enclosed within the probe and separated from the cathode by a gap, said the providing a target for the electron stream; and a shield assembly comprising a hollow shield electrode positioned within the probe and about the cathode.

33 Claims, 12 Drawing Sheets

U.S. PATENT DOCUMENTS

| | | | | |
|---|---|---|---|---|
| 6,438,206 | B1 * | 8/2002 | Shinar et al. | 378/123 |
| 6,480,568 | B1 * | 11/2002 | Dinsmore | 378/65 |
| 6,514,192 | B2 * | 2/2003 | Tiren | 600/3 |
| 6,546,077 | B2 * | 4/2003 | Chornenky et al. | 378/122 |
| 6,580,940 | B2 * | 6/2003 | Gutman | 600/427 |
| 6,623,418 | B2 * | 9/2003 | Smith | 600/3 |
| 6,661,875 | B2 * | 12/2003 | Greenwald et al. | 378/119 |
| 6,771,737 | B2 * | 8/2004 | Kerslick et al. | 378/122 |
| 6,799,075 | B1 * | 9/2004 | Chornenky et al. | 607/117 |
| 6,987,835 | B2 * | 1/2006 | Lovoi | 378/136 |
| 7,158,612 | B2 * | 1/2007 | Rusch et al. | 378/121 |
| 7,338,487 | B2 * | 3/2008 | Chornenky et al. | 606/33 |
| 7,466,799 | B2 * | 12/2008 | Miller | 378/140 |
| 7,771,117 | B2 * | 8/2010 | Kim et al. | 378/198 |
| 2002/0090053 | A1 | 7/2002 | Chornenky et al. | |
| 2003/0179854 | A1 | 9/2003 | Jaafar et al. | |
| 2003/0210765 | A1 | 11/2003 | Greenwald et al. | |
| 2005/0232392 | A1 | 10/2005 | Bradley et al. | |
| 2010/0002841 | A1 | 1/2010 | Jaafar et al. | |

OTHER PUBLICATIONS

H. Kobayashi et al., Abstract for "Radiotherapy for subfoveal choroidal neovascularization in age-related macular degeneration: a randomized clinical trial", American Journal of Ophthalmology, vol. 133, Issue 4, Apr. 2002, 1 page.

A.S. Baturin et al., "Electron gun with field emission cathode of carbon fiber bundle", J. Vac. Sci. Technol. B 21(1), Jan./Feb. 2003, Feb. 3, 2003, American Vacuum Society, 4 pages.

A.S. Baturin et al., "Lifetime and emission stability of carbon fiber cathodes", Materials Science and Engineering A353 (2003), Elsevier Science B.V., 5 pages.

* cited by examiner

FIELD EMISSION X-RAY APPARATUS, METHODS, AND SYSTEMS

CLAIM OF PRIORITY UNDER 35 U.S.C. §119

The present Application for patent claims priority to Provisional Patent Application No. 61/133,582 entitled "X-ray Apparatus for Electronic Brachytherapy" filed Jul. 1, 2008, and assigned to the assignee hereof and hereby expressly incorporated by reference herein.

BACKGROUND

1. Field

The presently disclosed embodiments relate generally to apparatus, methods and systems for generating x-rays using field emission technologies and the use thereof, principally in the area of brachytherapy.

2. Technical Background

Since the discovery of the x-rays by William Roentgen in 1895, practically all man-made x-ray generators have been built around the same basic design. This design comprises a tube housing two spatially separated electrodes (an anode and a cathode), a high voltage generator supplying voltage between the electrodes to create an accelerating electric field therebetween, and a means to create an electron beam directed from the cathode to the anode. In operation, electrons leave the cathode, are accelerated by the electric field, and impinge on the anode. As the electrons decelerate at the anode surface their kinetic energy in part is released in the form of an emission of x-rays.

A principle difference in the various such man-made x-ray generators is in the method of creating the electron beam. Basically, these methods include the use of a thermionic cathode to generate the electron beam or the use of an electron field emission effect. Each of these methods of x-ray production relies upon different technologies and different physical processes. Consequently, each method requires different hardware in implementing a particular method of x-ray production and use, with one methodology not necessarily being able to use the hardware of the other methodology.

X-rays produced with a thermionic cathode utilize a cathode heated to a temperature sufficient to cause electrons to "boil" off the cathode. The electrons are then pulled by an applied electric field to an anode. Upon striking the anode, a small portion of the electrons' kinetic energy is converted into x-rays, with the remainder being converted to heat. For this reason, most such x-ray devices utilize a rotating anode so that the heat is evenly spread over the anode.

As noted, x-rays can also be produced using field emission technology. Apparatus producing x-rays by field emission include a cathode and an anode held in a vacuum and the application of a high voltage electric field between them. The electric field pulls electrons from the cathode and accelerates them toward the anode with a kinetic energy dependent upon the electric field strength. Upon striking the anode, the electrons release some of their kinetic energy in the form of x-rays. The larger the operating voltage between the anode and cathode, the greater the energy that the produced x-rays will have.

The use of x-rays for therapeutic uses has been widely adopted. These therapeutic uses include, but are not limited to radiation therapy as a treatment for various forms of cancer. In addition, radiation therapy has been proposed for a form of a progressively degenerative eye disease known as macular degeneration.

Overview

Disclosed herein is an x-ray field emission apparatus, system and method, wherein the apparatus comprises a hollow probe held at vacuum; a cathode enclosed within the probe, wherein the cathode produces an electron stream when connected to a high voltage generator; an anode enclosed within the probe and separated from the cathode by a gap, wherein anode provides a target for the electron stream; and a shield assembly comprising a hollow shield electrode positioned within the probe and about the cathode.

Also disclosed herein is an x-ray field emission apparatus comprising a housing having proximal and distal housing ends; a hollow, substantially cylindrical probe having proximal and distal probe ends, the housing and probe being attached to each other and forming a single vacuum chamber; a cathode having proximal and distal ends disposed within the apparatus and longitudinally movable with respect thereto, the cathode producing an electron beam directed towards the distal probe end when connected to a high voltage negative potential; an anode disposed within the probe at the distal probe end, the anode and cathode separated by a gap; and a shield assembly comprising a hollow shield electrode positioned within the probe and about the cathode.

Further disclosed herein is an x-ray field emission apparatus comprising a housing having proximal and distal housing ends; a hollow, substantially cylindrical probe having proximal and distal probe ends, the housing and probe attached to each other and forming a single vacuum chamber; a cathode having proximal and distal ends disposed within the apparatus and longitudinally movable with respect thereto, the cathode producing an electron beam directed towards the distal probe end when connected to a high voltage negative potential, the cathode being made of a soft ferromagnetic material; an anode disposed within the probe at the distal probe end, the anode and cathode separated by a gap; and a shield assembly comprising a hollow shield electrode positioned within the probe and about the cathode.

An x-ray field emission apparatus comprising a housing having proximal and distal housing ends; a hollow, substantially cylindrical probe having proximal and distal probe ends, the housing and probe attached to each other and forming a single vacuum chamber; a cathode having proximal and distal ends disposed within the apparatus and longitudinally movable with respect thereto, the cathode producing an electron beam directed towards the distal probe end when connected to a high voltage negative potential, the cathode being made of a permanently magnetized hard ferromagnetic material; an anode disposed within the probe at the distal probe end, the anode and cathode separated by a gap; and a shield assembly comprising a hollow shield electrode positioned within the probe and about the cathode.

Also disclosed is a method of operating an x-ray field emission apparatus comprising providing an x-ray field emission apparatus comprising a housing having proximal and distal housing ends; a hollow, substantially cylindrical probe having proximal and distal probe ends, the housing and probe attached to each other and forming a single vacuum chamber; a cathode having proximal and distal ends disposed within the apparatus and longitudinally movable with respect thereto, the cathode producing an electron beam directed towards the distal probe end when connected to a high voltage negative potential; an anode disposed within the probe at the distal probe end, the anode and cathode separated by a gap; and a shield assembly comprising a hollow shield electrode positioned within the probe and about the cathode; and moving the cathode relative to the shield assembly to vary the current output of the anode.

A further disclosure included herein is of an x-ray field emission apparatus comprising: a housing having proximal and distal housing ends; a hollow, substantially cylindrical probe having proximal and distal probe ends, the housing and probe attached to each other; a cathode having proximal and distal ends disposed within the apparatus, the cathode producing an electron beam directed towards the distal probe end when connected to a high voltage negative potential; an anode disposed within the probe at the distal probe end, the anode and cathode separated by a gap; and a magnetic focuser for steering the electron beam towards the anode.

Further disclosed herein is an x-ray field emission apparatus comprising: a housing having proximal and distal housing ends; a hollow, substantially cylindrical probe having proximal and distal probe ends, the housing and probe attached to each other; a cathode having proximal and distal ends disposed within the apparatus, the cathode producing an electron beam directed towards the distal probe end when connected to a high voltage negative potential; an anode disposed within the probe at the distal probe end, the anode and cathode separated by a gap; a shield assembly comprising a hollow shield electrode positioned within the probe and about the cathode; a cathode high voltage generator electrically connected to the cathode; and a shield assembly high voltage generator electrically connected to the shield assembly; wherein the an electromstatic focuser comprises a shield assembly operated at a higher negative potential than the cathode.

Also disclosed herein is an x-ray field emission apparatus comprising: a hollow probe held at vacuum; a cathode enclosed within the probe, the cathode producing an electron stream when connected to a high voltage generator, the cathode having proximal and distal cathode ends; an anode enclosed within the probe and separated from the cathode by a gap, the anode providing a target for the electron stream; and a field emission element disposed at the distal cathode end wherein the field emission element is made of a composite material comprising carbon fibers embedded in a conductive binder.

DETAILED DESCRIPTION

Figure 1:
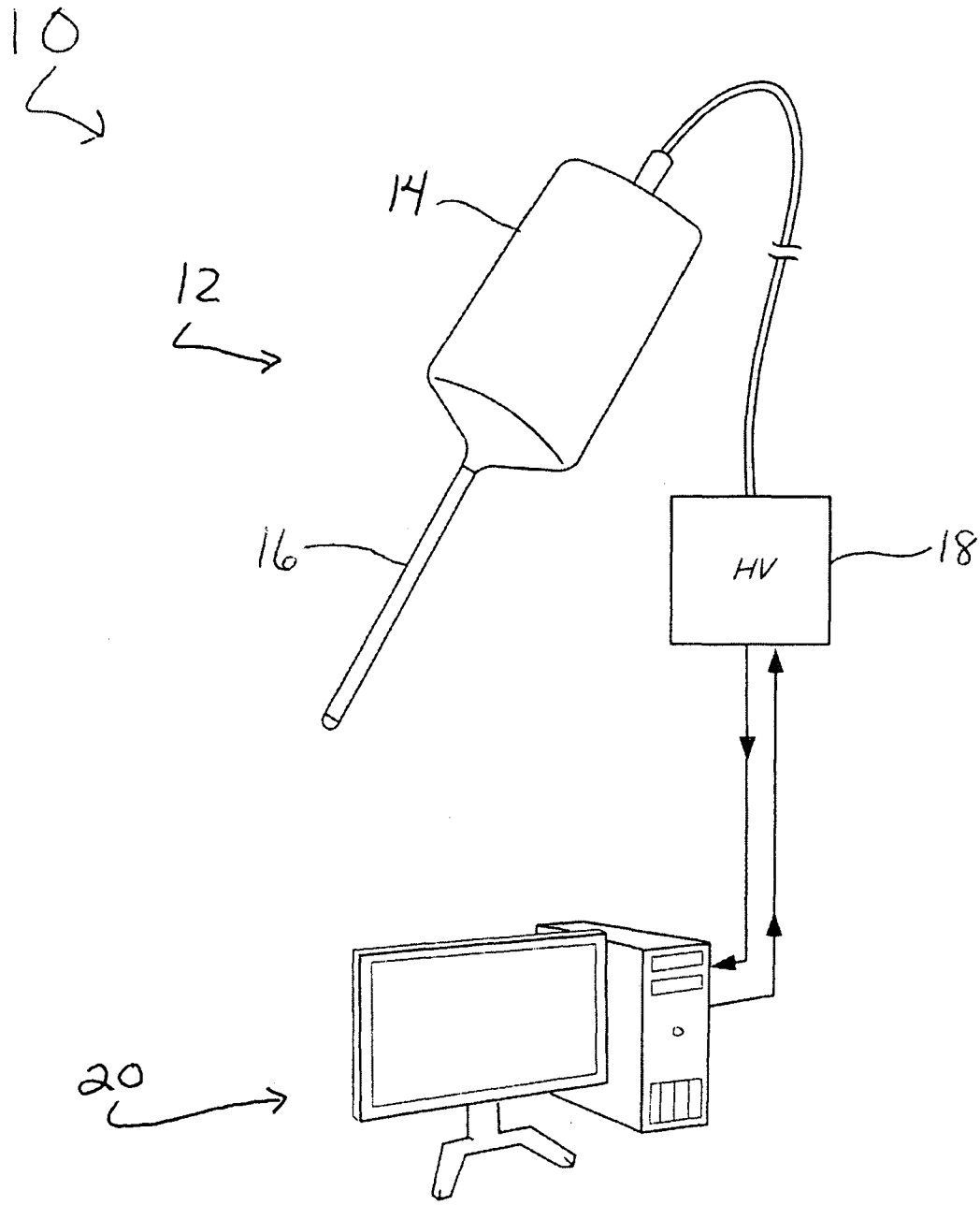
FIG. 1 illustrates a system for generating x-rays using field emission technologies wherein the methods and apparatus described further herein may find application.

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views. While several embodiments are described in connection with these drawings, there is no intent to limit the disclosure to the embodiment or embodiments disclosed herein. On the contrary, the intent is to cover all alternatives, modifications, and equivalents.

The word "exemplary" is used herein to mean "serving as an example, instance, or illustration." Any embodiment described herein as "exemplary" is not necessarily to be construed as preferred or advantageous over other embodiments.

Referring now to FIG. 1, an x-ray system 10 for generating x-rays using field emission technology is schematically illustrated. System 10 comprises an x-ray apparatus 12 including a housing 14 and a probe 16. The apparatus 12 is electrically connected to a high voltage generator 18. Activation of generator 18 creates a stream of electrons that passes from a cathode to an anode within the probe 16. When the electrons subsequently impact upon the anode, x-rays are generated.

The system 10 further includes a computer system 20, which is in communication with the high voltage generator. The computer 20 can monitor the voltage and current supplied by the generator 20 and supply real-time analysis of the operation of the apparatus 12, including real-time calculations of the intensity of the x-rays generated. As discussed further below, in a clinical setting where the apparatus is being used for therapeutic purposes such as radiation therapy for a cancer patient, the intensity of radiation applied to the patient can be precisely calculated. The computer system 20 can also be used to precisely control a regimen by enabling an operator to control the intensity of x-rays generated, the time period during which they are generated and the direction of the x-ray output from the apparatus 12. In addition, the computer system 20 can also be used, if desired, to monitor or control one or more (in addition to any other parameter desired to be measured and/or controlled) of following: temperature; coolant flow and coolant temperature where a cooling system is used in conjunction with the apparatus 12; and the position and orientation of the apparatus 12 relative to a radiation target of interest, etc.

It will be understood that the x-ray apparatus 12 is schematically represented in FIG. 1. Both housing 14 and probe 16 can take on a variety of dimensions depending upon the particular application. For therapeutic uses in a clinical setting it is anticipated that the cross sectional area of the probe 16 will be substantially less than that of the housing 14. It will be understood, then, that as shown herein, the probe 16 is shown enlarged relative to the housing 14 for purposes of clearly illustrating the various parts thereof. Additionally, both the housing 14 and probe 16 can take on a variety of shapes depending upon a particular application. For example, housing 14 is shown as having a cylindrical configuration, though such a shape is neither required nor critical to the operation of the present invention. In many applications of an apparatus 12 it will be held within an appropriate mechanical support frame (not shown) of types well known in the art to allow translation and rotation of the apparatus 12, thereby enabling relatively precise positioning relative to a target of interest for application of x-rays generated by the apparatus 12. In such circumstances, other shapes—such as square, pentagonal, hexagonal, etc., may be more appropriate for use in conjunction with the support frame to reduce the likelihood of slippage between the housing and the frame.

Thus, certain uses may require or make desirable both housing 14 and probe 16 of different lengths, different cross-sectional configurations, and different cross-sectional areas than the cylindrical cross-sections illustrated and described herein, and all such configurations are within the scope of the embodiments disclosed.

In some embodiments, housing 14 and probe 16 can enclose communicating vacuum spaces. In other embodiments, it may be desirable only to make the probe 16 or parts thereof enclose a vacuum, though other aspects of the probe and housing may require reconfiguration of the constituent components enclosed therein and more complex sealing arrangements as a result.

Figure 2:
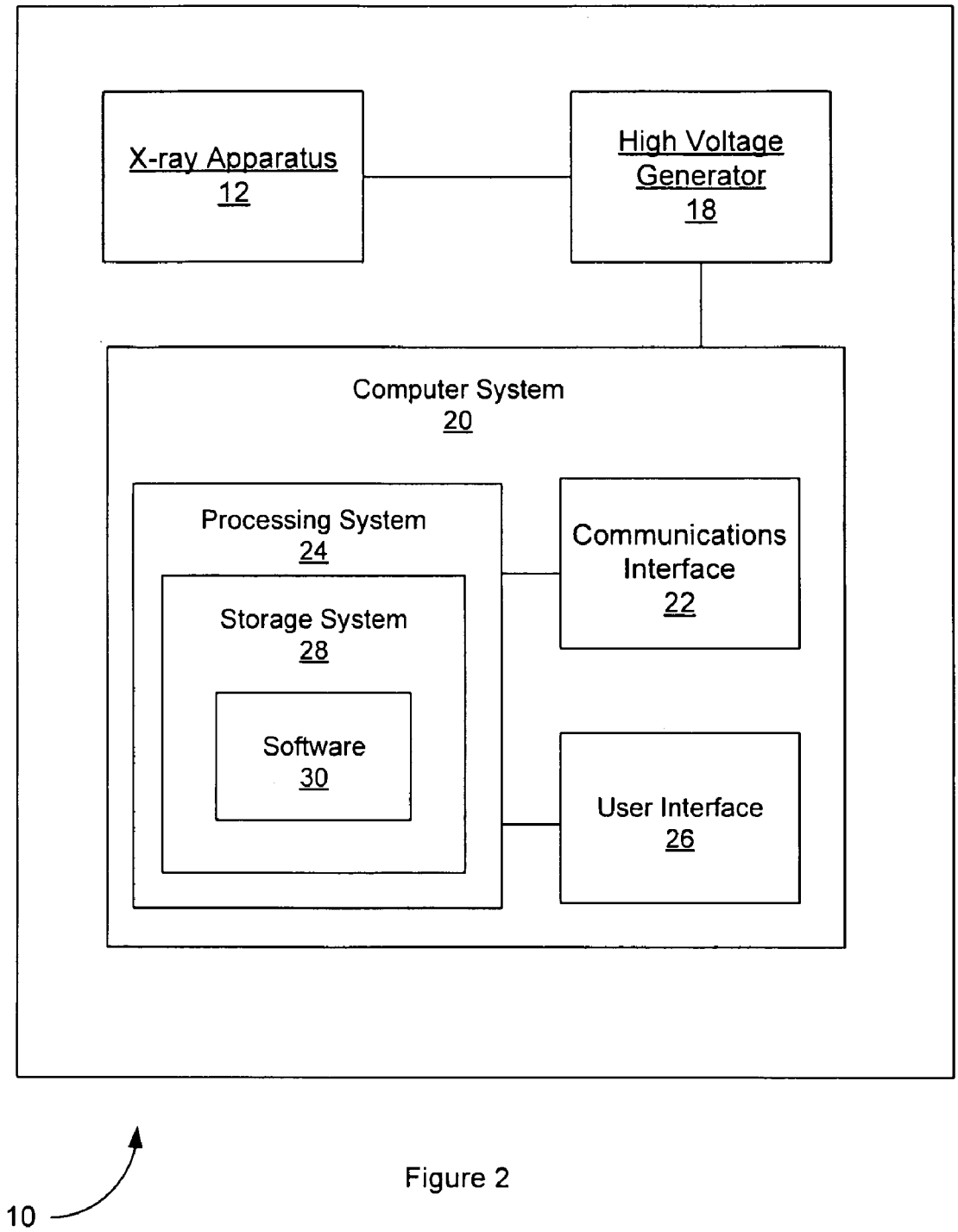
FIG. 2 illustrates in a block diagram form a system for generating x-rays using field emission techniques wherein the methods and apparatus described further herein may find application.

FIG. 2 illustrates a block diagram of a field emission x-ray system 10 in accord with which the various embodiments disclosed herein may find application. System 10 includes an x-ray apparatus 12, a high voltage generator 18, and a computer system 20.

Computer system 20 includes communication interface 22, processing system 24, and user interface 26. Processing system 24 includes storage system 28. Storage system 28 stores software 30. Processing system 24 is linked to communication interface 22 and user interface 26. Computer system 20 could be comprised of a programmed general-purpose computer, although those skilled in the art will appreciate that programmable or special purpose circuitry and equipment may be used. Computer system 20 may be distributed among multiple devices that together comprise elements 22-30.

Communication interface 22 could comprise a network interface, modem, port, transceiver, or some other communication device, thereby enabling remote operation of the system 10 if desired. Communication interface 22 may be distributed among multiple communication devices. Processing system 24 could comprise a computer microprocessor, logic circuit, or some other processing device. Processing system 24 may be distributed among multiple processing devices. User interface 26 could comprise a keyboard, mouse, voice recognition interface, microphone and speakers, graphical display, touch screen, or some other type of user device. User interface 26 may be distributed among multiple user devices. Storage system 28 could comprise a disk, tape, integrated circuit, server, or some other memory device. Storage system 28 may be distributed among multiple memory devices.

Processing system 24 retrieves and executes software 30 from storage system 28 for the operation of x-ray system 10. Software 30 may comprise an operating system, utilities, drivers, networking software, and other software typically loaded onto a computer system. Software 30 could comprise an application program, firmware, or some other form of machine-readable processing instructions. When executed by processing system 24, software 30 directs processing system 24 to operate as described herein.

The methods disclosed herein may be implemented as firmware in processing system 24 or software or a combination of both.

Figure 3:
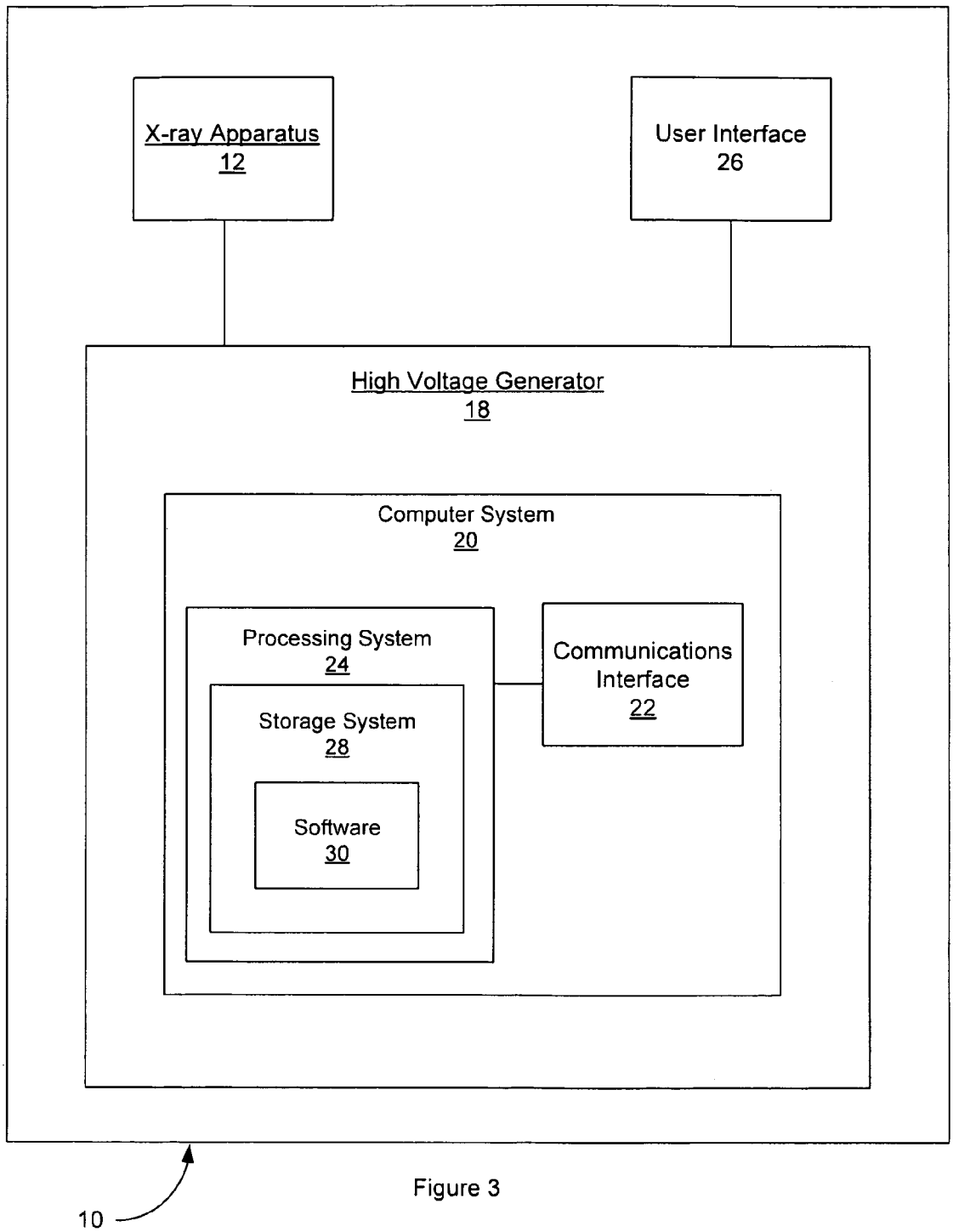
FIG. 3 illustrates in a block diagram form a system for generating x-rays using field emission techniques wherein the methods and apparatus described further herein may find application.

FIG. 3 illustrates an alternative version of system 10 wherein the high voltage generator 18 includes the computer system 20. In either embodiment shown in FIGS. 2 and 3, the high voltage generator will include the necessary microcircuitry, electronics and software/firmware to control as precisely as desired the generation of a high voltage and its provisioning to the x-ray apparatus 12.

The computer system 20 is provided, as noted earlier, as a means for inputting desired dosage levels and dwell times (the length of time that the apparatus is maintained at a particular position relative to a target of interest), amongst other functionalities disclosed herein. By way of example only, in some cases of breast cancer a tumor may be excised. Application of radiation therapy to a predetermined volume of the remaining breast tissue may be made with the apparatus, systems, and methods disclosed herein and the positioning and dwell times of the apparatus 12 relative to that predetermined volume may be controlled by the computer system 20.

Figure 4A:
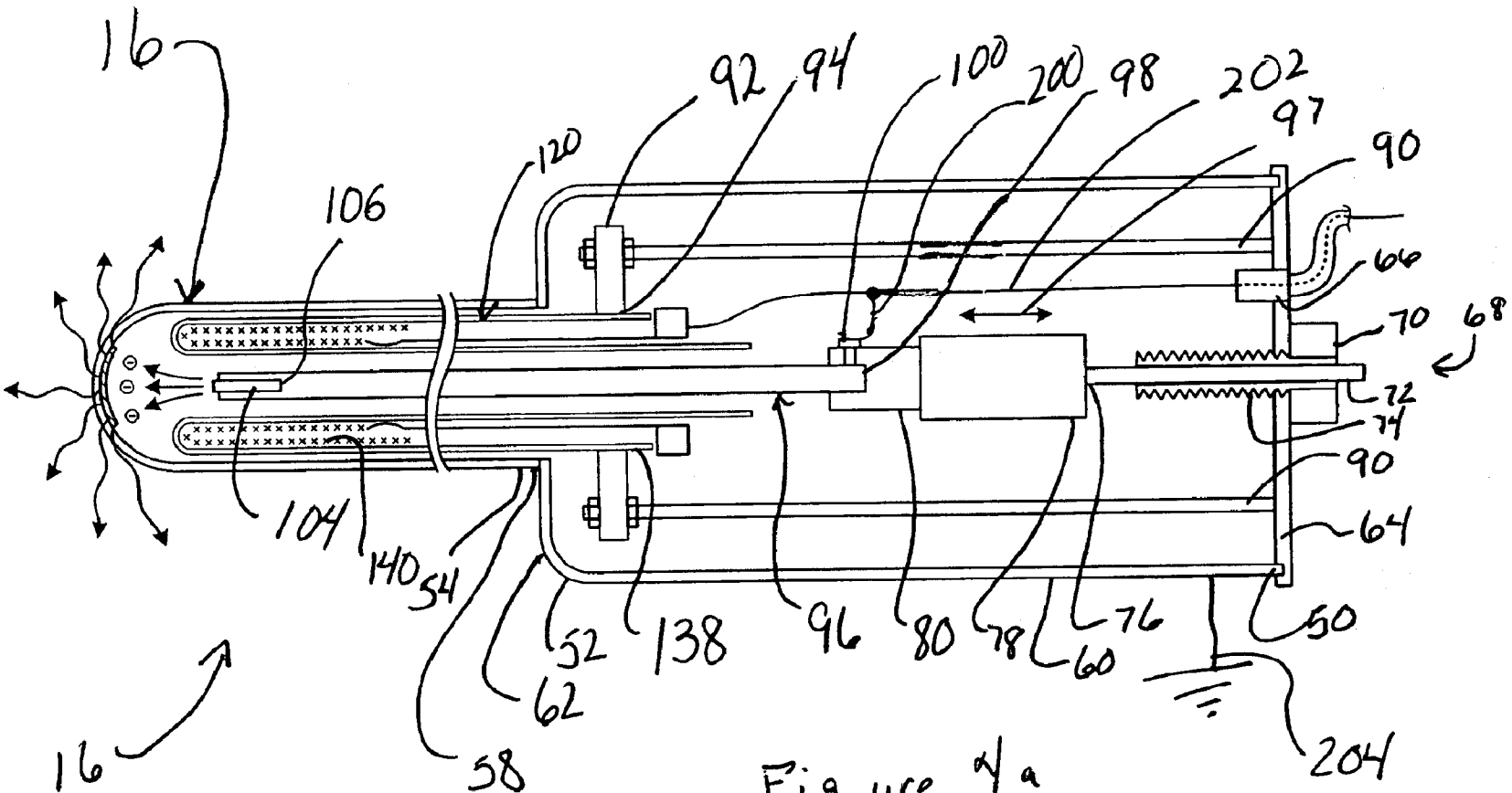
FIG. 4*a* illustrates a partial cross-sectional view an x-ray apparatus in accord with the embodiments disclosed herein.
Figure 4B:
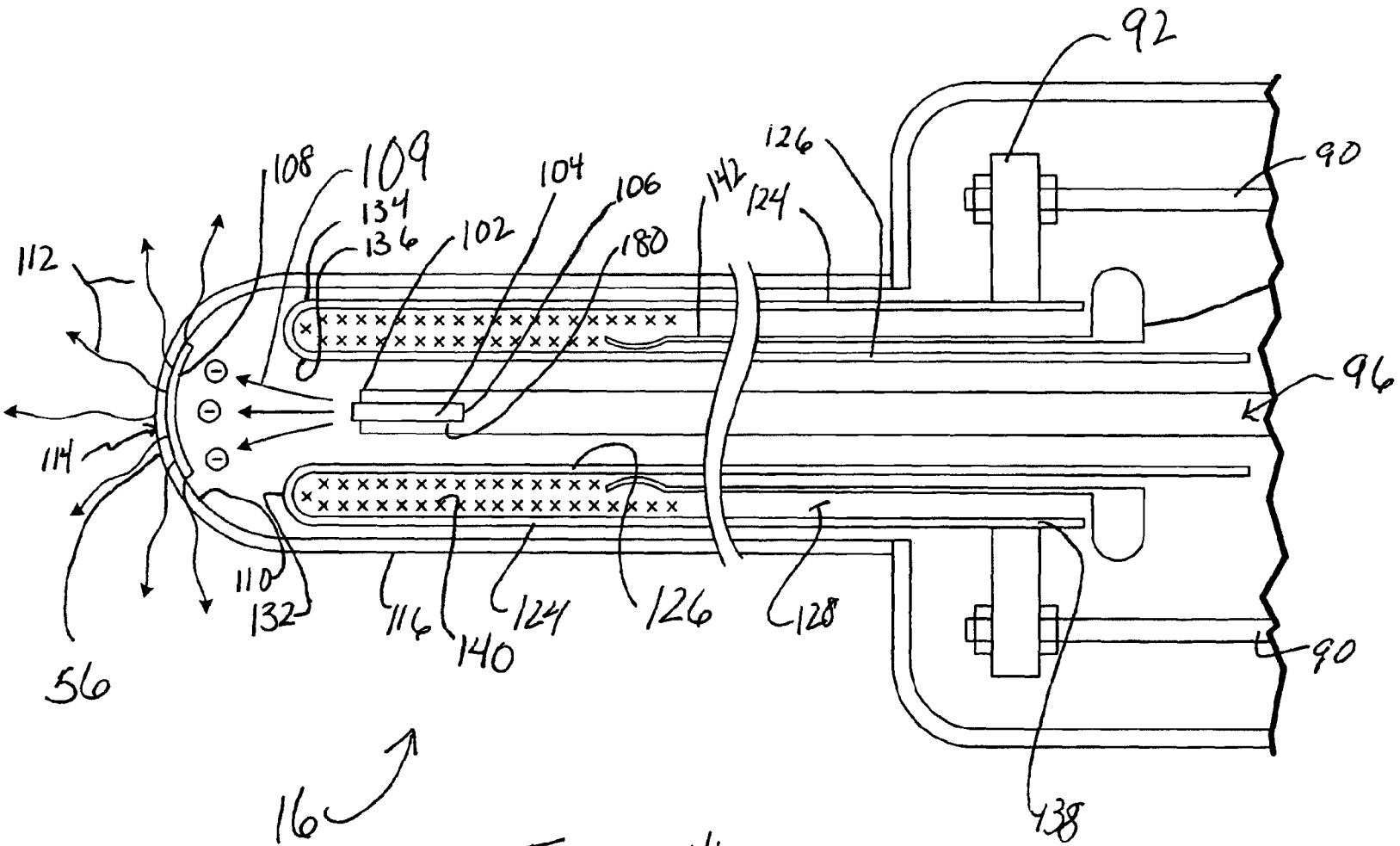
FIG. 4*b* illustrates an enlarged view of portions of FIG. 4*a*.

FIGS. 4*a* and 4*b* illustrates in partial cross section an embodiment of an x-ray apparatus 12 in accord with the disclosures herein. Apparatus 12 includes a housing 14 and a probe 16, the interiors of which are both held at vacuum. The housing 14 includes proximal and distal ends 50 and 52, respectively, while probe 16 includes proximal and distal ends 54 and 56, respectively. In one embodiment, housing 14 and probe 16 are manufactured and attached to each other at proximal probe end 54 and distal housing end 52 at a joint 58 with a vacuum-tight seal. In another embodiment, the housing 14 and probe 16 can be manufactured as a unitary workpiece if desired.

As illustrated, the probe 16 has a smaller cross-sectional area than the housing 14. Other embodiments may have the probe 16 and housing 14 having substantially equal cross sectional areas.

As shown in the Figures, housing 14 includes a cylindrical body 60, though as noted with respect to FIG. 1 other cross-sectional configurations may be acceptable or desirable in particular applications. In addition, the housing 14 includes a distal housing end cap 62 and a proximal housing end cap 64. If desired, end cap 62 can be manufactured separately from cylindrical housing body 60, though that will necessitate a vacuum seal between the two.

Housing proximal end cap 64 includes a vacuum-sealed electrical feed-through 66, thereby providing an electrical connection between the x-ray apparatus 12 and the high voltage generator 18. Also extending through the proximal end cap 64 is a vacuum sealed linear actuator 68. Actuator 68 comprises a nut 70, a threaded screw or shaft 72, and a bellows 74, which provides the vacuum seal for the actuator. The distal end 76 of the screw 72 is connected to the proximal end of an electrical insulator 78. The distal end of the insulator 78 is in turn attached to a cathode holder 80. The insulator 78 may be made of any material useful with the application or use of x-ray apparatus 12, such as a ceramic material, alumina or macor.

Housing end cap 64 also supports at least a pair of support rods 90 that extend substantially the length of the housing 14. The support rods 90 can be attached to end cap 64 in any manner sufficient to provide a rigid support for an insulating annular support disk 92 attached at the other ends of the support rods 90, again by any known suitable manner, including threaded rod ends and screws as shown (or brazing, adhesives, etc.) As noted, disk 92 is annular and thus includes a centrally disposed through hole 94.

Still referring to FIGS. 4*a* and 4*b*, cathode holder 80 supports a cathode 96, manufactured from a ferromagnetic material, at its proximal end 98. Cathode 96 is movable in an axial direction as indicated by double headed arrow 97 by means of actuator 68. Proximal cathode end 98 may be attached in any known manner to the cathode holder 80, such as the tightening screw 100 depicted in the figure. As shown, cathode 96 has an elongate, cylindrical configuration and may be made from magnetic materials like nickel, low carbon steel, high carbon steel, or special ferromagnetic alloys such as, but not limited to, rare earth magnetic alloys like samarium cobalt or neodymium-iron-boron.

It will be understood that cathode 96 need not have the elongate configuration shown; cathode 96 may, if desired, be disposed at the most distal end of a support structure and electrically connected to the generator 18. In other words, the cathode 96 could occupy only a small portion of the distal length of the elongate rod structure depicted in the Figures, with the remainder of the depicted rod-like structure forming an elongated segment of the cathode holder previously described. Such variations in the size of the cathode 96 are within the scope of the present disclosure.

The distal end 102 of the cathode 96 supports a field emission element 104. As shown, the field emission element 104 is disposed within a cavity or recess 106 in the distal end of the cathode 96. Field emission element 104 will be described in greater detail with regard to FIGS. 7 and 8.

Figure 7:
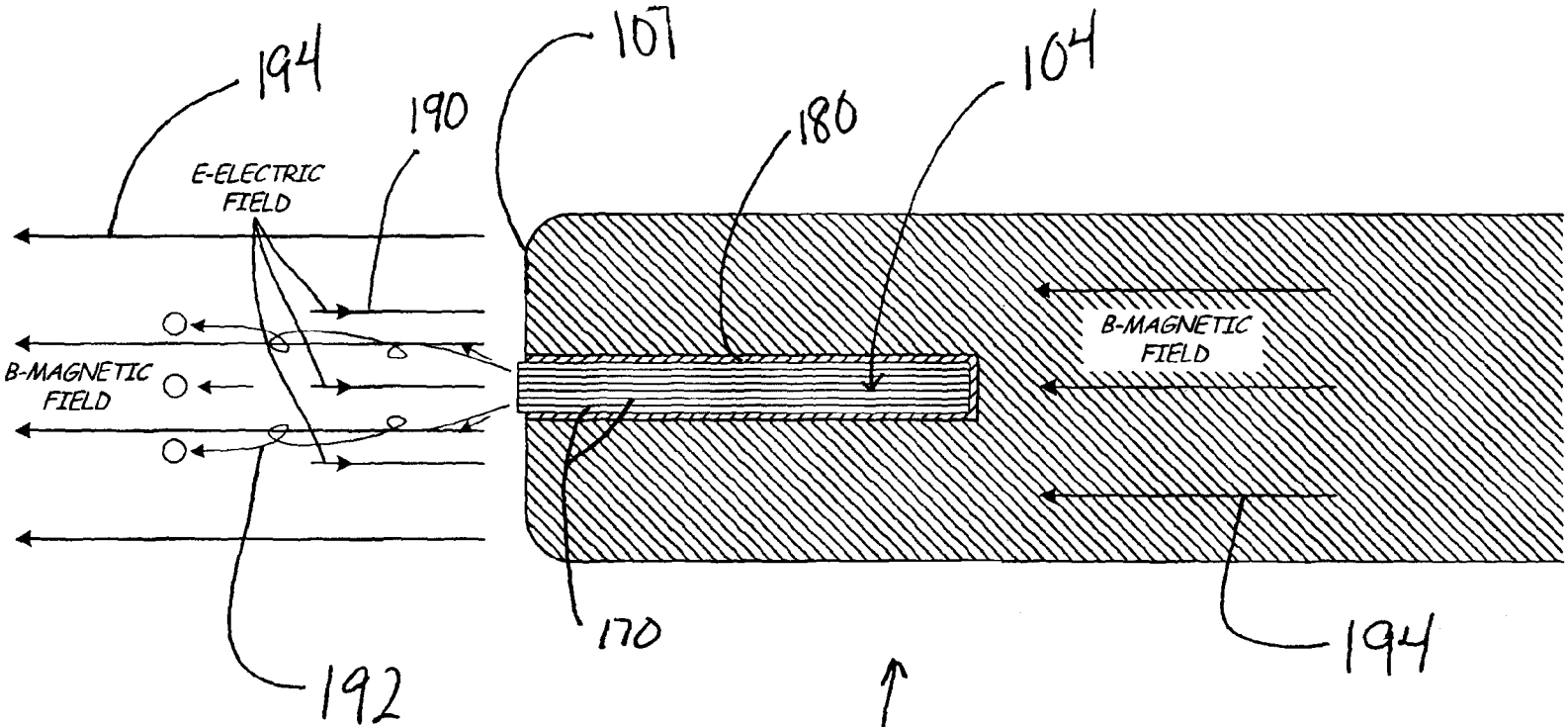
FIG. 7 illustrates a distal end of a cathode and field emission element in cross section in accord with disclosures herein.
Figure 8:
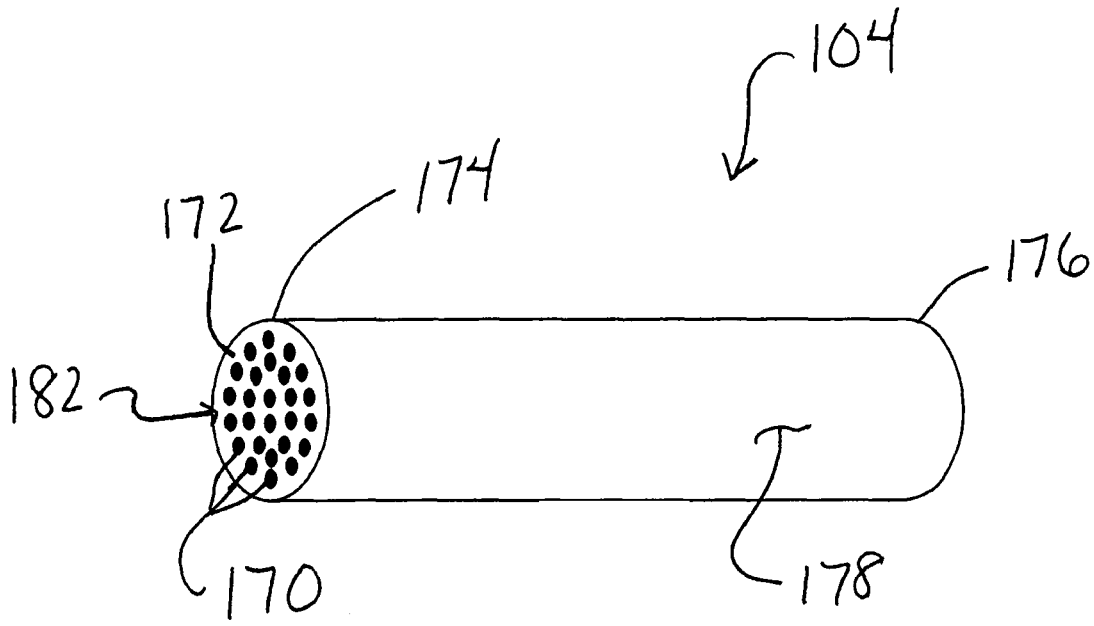
FIG. 8 illustrates a field emission element in accord with the disclosures herein.

The distal end of the cathode is shown in FIGS. 7-8. Cathode 96 includes a distal surface 107 that faces the anode 108 (FIGS. 4*a* and 4*b*). This surface 107 is thoroughly polished to keep the electric field on the cathode distal surface 107 parallel to the axis of the device and to avoid any sharp protrusions that can produce undesired field emission. When an operating voltage is applied between the cathode 96 and anode 108, an axial electric field E appears at the surface 107 and the distal end of the field emission element 104.

In use, cathode 96 will produce an electron beam 109 directed somewhat generally towards the distal end 56 of the probe 16. The electrons are accelerated by an electrical field created between the cathode 96 and the anode 108, which is attached to the inside surface 110 of the probe 16. The anode 108 may be made of metals having high atomic numbers such as gold or tungsten or alloys of high atomic number metals. When the electron beam 109 strikes the anode 108, the electrons will release a portion of their kinetic energy as x-rays 112 as described above.

As illustrated the probe 16 includes a probe end cap 114, which may be manufactured integrally with the probe body 116 or separately and attached later to the probe body 116. The end cap 114 may be manufactured of any material compatible with the applications described herein, with the sole limitation that it must be transparent to the generated x-rays.

Figure 5B:
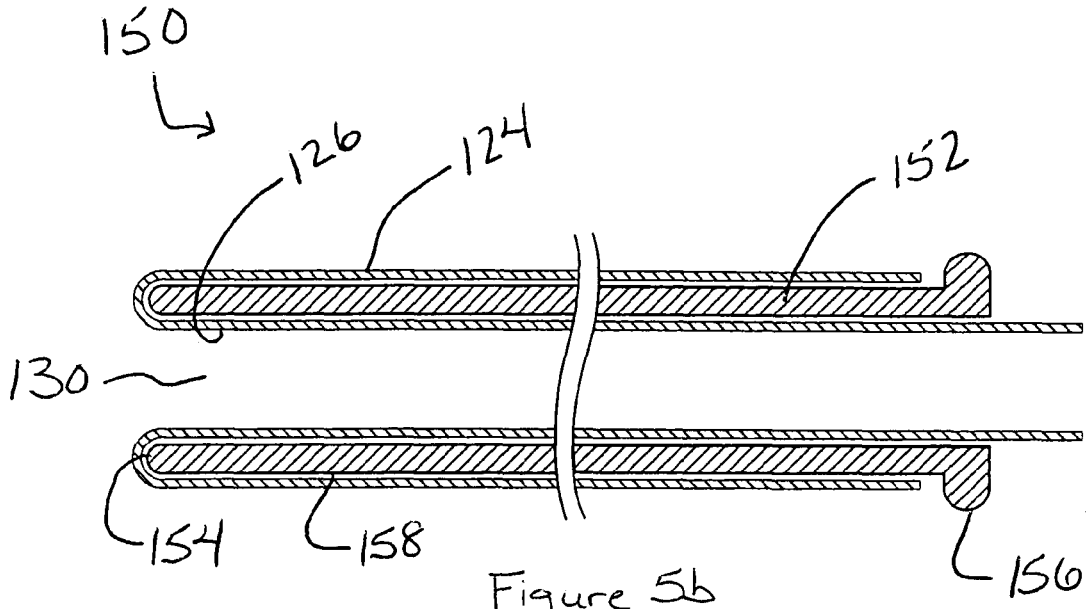
FIGS. 5*a* and 5*b* illustrate alternative embodiments of a shield assembly in accord with the disclosures herein.
Figure 5A:
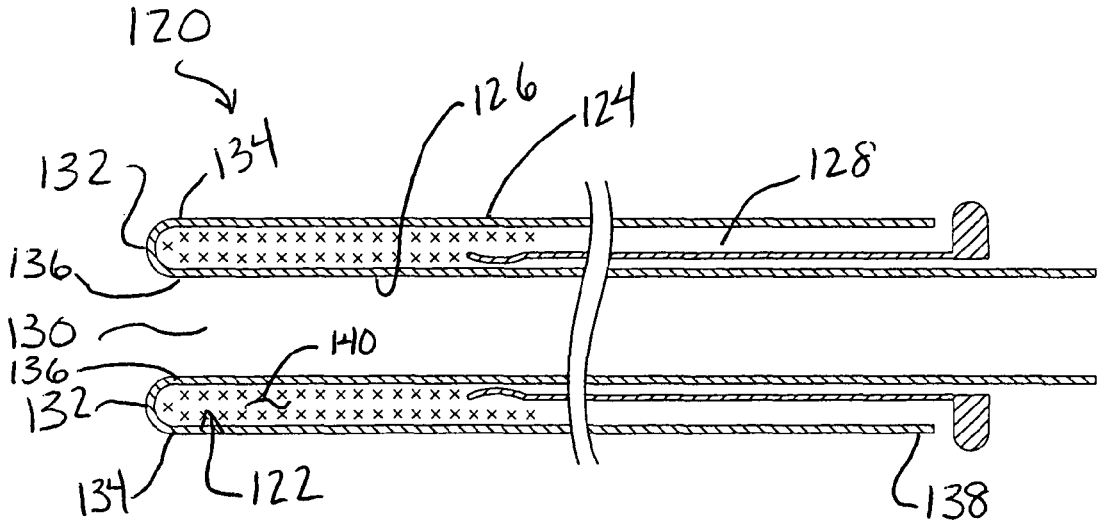

Also shown in FIG. 4 as well as in greater detail in FIG. 5*a* is an embodiment of a shield assembly 120. Referring now to both FIGS. 4 and 5*a*, shield assembly 120 provides an increased operating voltage and improved control of the electric field at the field emission cathode. Shield assembly 120 comprises a shield or cylindrical electrode 122 coaxially disposed about the cathode 96. Shield assembly 120, in the embodiment shown in FIG. 4 as well as the enlarged view of FIG. 5*a*, also comprises a pair of concentric cylindrical insulating outer and inner members or tubes 124 and 126 separated by a gap 128 and disposed substantially coaxially about the cathode 96. A hollow space 130 inside the inner member 126 is appropriately configured to receive the cathode 96. An annular end cap 132 closes the distal ends 134 and 136 of cylindrical members 124 and 126, respectively, while the proximal end 138 of the cylindrical member 124 is attached in any known manner consistent with the use or application of the x-ray apparatus 12 to the annular support disk 92, such as, but not limited to, a ceramic adhesive joint.

The end cap 132 can be manufactured separately from separately manufactured cylindrical members 124 and 126 and subsequently attached thereto, or the members 124 and 126 and end cap 132 can be manufactured as a unitary structure as desired. Members 124 and 126 are made of a non-conductive material. One such material that may be used is a quartz material such as fused quartz. Fused quartz may be advantageously utilized in the embodiment shown because it possesses a high dielectric strength—about 600-700 kV/mm (kilovolts/millimeter)—and a resistivity of $10^{18}$ Ohm cm (Ohm-centimeters). Consequently, a shield assembly 120 utilizing fused quartz may be configured as quartz tubes having only a fraction of a millimeter wall thickness while still enabling x-ray apparatus 12 to substantially maintain an operating voltage of more than a hundred kilovolts without breakdowns or a noticeable leakage current.

Stated otherwise, without a shield assembly 120, the apparatus 12 may experience breakdowns and a current leakage between cathode 96 and the wall structure forming probe 16. The cylindrical electrode 122 is held at substantially the same potential as the cathode 96, thereby effectively shielding the cathode 96 from the probe 16, which is at the opposite polarity. Furthermore, the use of insulating members 124 and 126 having a high dielectric constant and resistivity to surround the cylindrical electrode 122 further aids in preventing any discharges from either the cathode 96 or the cylindrical electrode 122 to the probe 16.

As seen in the embodiments shown in FIG. 4 and Sa, the cylindrical electrode comprises a conductive coating 140 deposited on the inner or shield assembly gap 128 facing surfaces of the distal end of the enclosure created between the members 124 and 126. The conductive coating 140 can be deposited on the facing surfaces of the members 124 and 126 by any method known in the art, such as chemical vapor deposition methods of depositing metals or graphite on the surface of the insulators. Conductive coating 140 is electrically connected to the negative pole of generator 18 via an electrical connector 142 that connects the coating 140 to the high voltage power supply 18.

Referring to FIG. 5*b*, an alternative embodiment of shield assembly 150 is illustrated. As shown there, shield assembly 150 comprises members 124 and 126. In this embodiment the cylindrical electrode 122 comprises a metal tubular electrode 152 placed inside the enclosure made by the two members 124 and 126. The distal end 154 of the electrode 152, where the electric field during operation of the device is the highest, is rounded and highly polished. The proximal end 156 of the electrode 152 is electrically connected via a connector to the negative pole of the generator 18. The proximal end 156 of the electrode 152 extends to the vacuum housing 14 (not shown). Because, as previously noted, the diameter of the housing 14 will usually be many times larger than that of the probe 16, the electric field at the proximal end 156 of the electrode 152 is significantly lower than the field on its distal end. Indeed, for all practical purposes, the electric field at the surfaces of all conductors inside the housing 14 is less than the field required for high voltage vacuum breakdown, thereby preventing discharges to the housing 14.

In the FIG. 5*a* embodiment, the conductive coating is tightly applied to the surface of the members 124 and 126, without even a microscopic gap. In the embodiment shown in FIG. 5*b* there is always a vacuum gap 158 between the surface of the electrode 152 and the surface of the members 124 and 126. This gap 158 enhances the electric field on the surface of the insulator members 124 and 126 by a factor of E, which is the dielectric constant of the insulating material utilized in members 124 and 126. For an embodiment where fused quartz is used for members 124 and 126, the dielectric constant is 4, which causes a significant field enhancement. The absence of the enhancement in the embodiment shown in FIG. 5*a* provides an opportunity to work with significantly higher operational voltages than for the embodiment of FIG. 5*b*.

To reduce the flashover discharges occurring it is desirable to provide some focusing of the electron stream. In the embodiment illustrated in FIGS. 4*a* and 4*b* the cathode may be manufactured from a permanently magnetized material and provide as a result an axially directed magnetic field that will function to steer the electron stream produced by the cathode towards the anode and away from the wall of the probe 16. Such a cathode may be made of a hard ferromagnetic material (high carbon steel or special alloys) that is magnetized before assembly into the apparatus 12.

Figure 6:
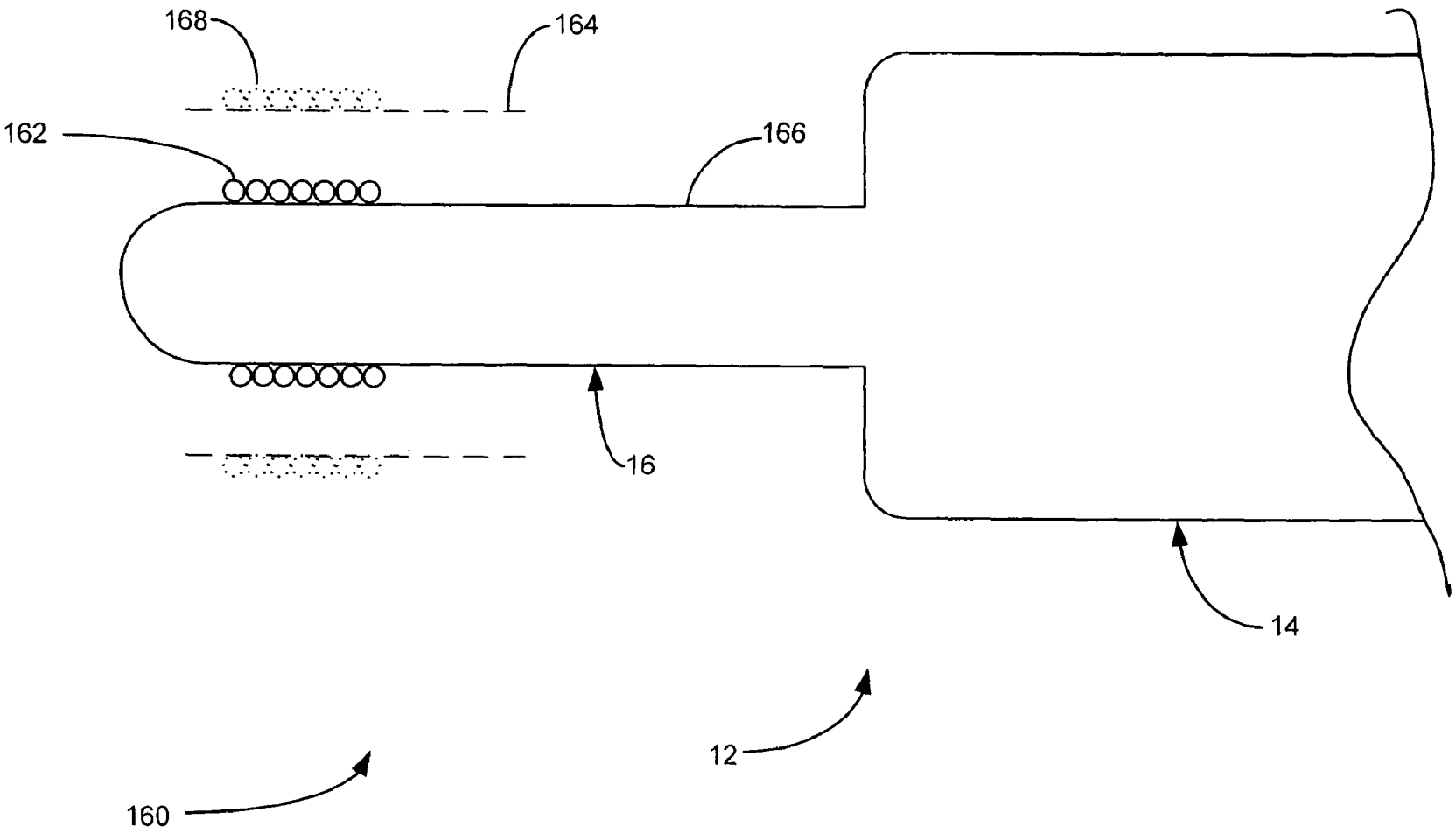
FIG. 6 illustrates another embodiment of apparatus in accord with the disclosures herein wherein a wire coil is disposed circumferentially about the exterior of the probe.

Referring now to FIG. 6, another embodiment 160 of an x-ray apparatus is shown wherein an axially directed magnetic field is provided by an electrically energized coil. Thus, in this embodiment, an electromagnetic coil 162 is disposed externally of the external surface 166 of the probe 16 near its distal end. Electromagnetic coil 162 may be wound directly about the probe 16 as shown. The present embodiment is not so limited, however, since the x-ray apparatus 12 may, in some applications, utilize a cooling system. In such circumstances, the probe 16 may be disposed within a cooling jacket 164 (shown in partial phantom outline) through which fluid circulates to remove heated generated during operation of the apparatus 12. When such a cooling system is used, it may be advantageous to place the electromagnetic coil on the exterior of such a cooling jacket 164 rather on the external surface 166 of the probe 16. Such an embodiment is schematically illustrated in FIG. 6, wherein an electromagnetic coil 168 is shown in phantom displaced from the probe surface 166. It will be understood that either or both coils 162 and 168 may be used as desired or needed depending upon the particular application for which the apparatus 12 is used. It will further be understood that the number of coils illustrated is meant simply to indicate such a coil. The actual number of coils utilized will depend upon the magnetic field strength desired as well as the operating parameters of any equipment energizing the coils 162 and/or 168.

When energized by the appropriate current, coil 162 or 168 will magnetize the cathode 96 (not shown in FIG. 6), which as noted can be made of a soft ferromagnetic material such as low carbon steel or nickel, and thus will create a strong axially directed magnetic field at its surface. If desired, coil 162 may be, but need not be, utilized with the previous shield embodiments described with regard to FIGS. 4-5*b*. Thus, coil 162 may also be used to focus thee electron beam emitted by the cathode 96.

Thus, the present disclosure provides for apparatus, system and methods for creating a focusing magnetic field that steers or directs the electron beam 109 towards the target material—the anode 108.

Referring now to FIGS. 7 and 8, the field emission element 104 will be described. As previously described, cathode 96 includes at its distal end a field emission element from which the electron beam 109 is emitted. Field emission element 104 may be advantageously configured to have a substantially cylindrical shape, though the present embodiment is not so limited and other shapes and configurations may find use in the present embodiments. Field emission element 104 is made of a solid cylindrical body made of a composite material comprising carbon fibers 170 embedded in a binder 172, such as a conductive ceramic or conductive glass.

Stated in greater detail, the field emission element 104 includes a distal, operating end 174 and a proximal end 176, which together with the side 178 of the field emission element 104 are secured in an axially extending cavity 106 (best seen in FIGS. 4 and 7) in the distal end of the cathode 96 with a conductive adhesive 180, such as a conductive ceramic adhesive. The electron beam emitting tips of the fibers are best seen in FIG. 8. Preferably, the operating or electron beam emitting surface 182 of the field emission element 104 will be mirror polished to reduce or eliminate any significant protrusions on its surface. The polished surface provides a minimum of distortions of the electric field and the emitting pattern.

In one embodiment of field emission element 104 the carbon fibers are continuous and constitute a laminated structure stretched along the element 104. In another embodiment the carbon fibers 170 are short in comparison with the length of the field emission element 104.

A field emission element 104 can be manufactured by mixing the fibers by any known method with a conductive ceramic adhesive or matrix material in a proportion in the range of 60% to 90% to the matrix material by weight and extruded into cylindrically shaped rods. Subsequently, the rods are fired in an oven at a temperature appropriate for the particular adhesive matrix being used. The rods are then cut to size and polished at the operating end. A plurality of fiber ends, regardless of their length, at the operating surface 182 of the rod provides field emission of electrons normally to the surface when an adequate electric field is applied.

In an alternative manufacturing method, the mixture of the conductive ceramic adhesive and carbon fibers may be placed into molds rather than extruded, and fired thereafter As shown in FIGS. 4*a*, 4*b* and 7, the distal end of the field emission element 104 extends beyond the cathode distal surface 107. It will be understood that the field emission element 104 could also be disposed within the recess 106 such that distal end surface 182 of the field emission element 104 would lie parallel with the cathode distal surface 107.

Referring back to FIG. 4*a*, x-ray apparatus 12 is electrically connected to a high voltage generator 18 via the feedthrough 66. Appropriate electrical connectors 200 and 202 respectively connect the cathode 96 and shield assembly 120 to the generator 18. The housing 14, meanwhile, is grounded at 204.

Operationally, under the influence of the electric field the emission element 104 emits electrons that move to the anode on trajectories predominantly parallel to both the electric (E) and magnetic (B) fields. The magnetic field does not interact with electrons moving parallel to it. This case is illustrated in FIG. 7 by a trajectory marked by the numeral 190. Some electrons though are emitted under an angle to the magnetic field. In FIG. 7 their trajectories are marked by a numeral 192. The vectors of velocities of these electrons have components perpendicular to the magnetic field 194 created by the various features of apparatus 12 as described earlier, which leads to interaction of these electrons with the magnetic field. These trajectories become spiral curves wounded around the axis of the device. In other words, the magnetic field exerts a focusing effect on the electron beam preventing electrons from hitting the surface of the inner insulating member 126 and creating a flashover discharge. Also, due to the photoelectric effect, the x-ray radiation generated during operation knocks out some electrons from insulating member 126 near the tip of the cathode and charges the member 126 positively. This surface charge on the insulating member 126 distorts the electric field at the cathode tip and attracts electrons to the member 126. The magnetic field created by the various embodiments disclosed herein successfully copes with this problem too and keeps the electron beam off the inner insulating member 126 and thus makes the apparatus more stable against flashover discharges.

The illustrated and disclosed x-ray apparatus in its various embodiments renders good control of the electric field at the tip of the cathode 96 and as a consequence, the field emission current from the cathode. As can be seen from FIG. 4*a* the cathode 96 is disposed coaxially with the shield assembly 120 and is engaged with the linear actuator 68, so it can be moved back and forth along the axis of the device. The electric field at the end of the shield is highly non-uniform. When the cathode 96 is moved towards the anode 108 so that the distal cathode end 102 extends distally of the distal end of the shield assembly, the electric field on the distal cathode surface 107 increases up to a very high value. When the cathode is moved away from the anode deeper inside the shield assembly 120, the electric field on the distal cathode surface 107 decreases, trending to practically zero. This reduction in electric field strength is a consequence of the "Faraday cage effect", which states that inside any conductor the electric field is zero. No matter how high the electric field is outside the shield assembly 120, inside it the electric field seen by the distal cathode surface 107 is low. Operationally, the actual travel distance of the cathode 96 and, hence, the distal cathode surface 107, will be small and in one embodiment bay be within the range of about 0.5 to about 5.0 millimeters (about 500 microns to about 5000 microns) This travel distance is sufficient to vary the field emission current provided by the cathode 96 from a value of less than 1 microampere to over 1,000 microamperes.

Figure 9:
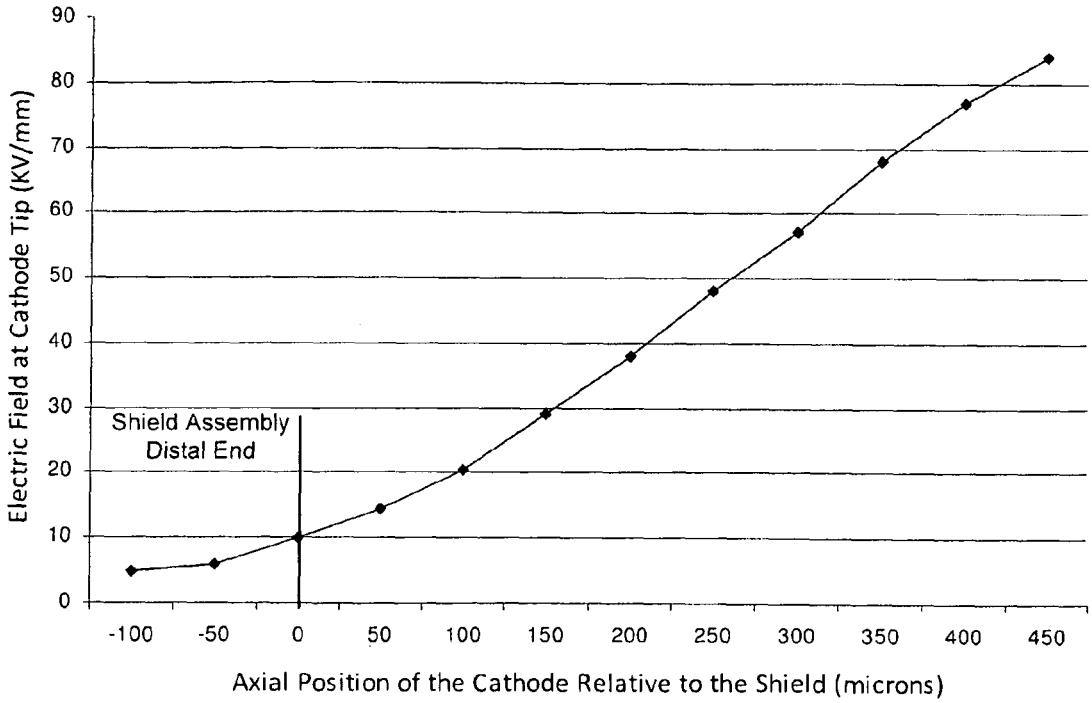
FIG. 9 illustrates a graph showing the electric field strength as a function of the relative position of the distal cathode end and the distal shield assembly end.

The relationship between the position of the distal cathode tip relative to the distal end of the shield assembly 120 and the effect thereof on the operating electric field is shown in FIG. 9. The horizontal or x-axis shows the relative positions of the distal cathode surface 107 and the distal shield assembly end 134 in microns. Thus it will be understood that 0 (zero) on the graph illustrates a cathode position wherein the distal cathode surface 107 lies parallel with the distal shield assembly end 134. The vertical or y-axis represents the electric field strength at the distal cathode surface 107 in kilovolts/millimeter (KV/mm). It will be observed that as the cathode distal tip is withdrawn into the shield assembly 120 and away from the anode 108 that the electric field strength decreases and trends toward zero field strength. Similarly, as the distal cathode surface 107 of the cathode 96 is moved towards the anode 108 and first towards and then beyond the distal end of the shield assembly 120 that the electric field strength increases.

It will be understood that the shape of the graph shown in FIG. 9 will depend upon several factors, including but not limited to the scales of the units chosen for the axes; whether the data is shown in linear or logarithmic form; and the operating parameters of the x-ray apparatus 12.

Stated otherwise, while the distal end of the cathode is disposed deep within the shield assembly, the field emission current between the cathode 96 and anode 108 will be zero. As the cathode and anode are moved closer together, the field emission current will rise from zero to a predetermined microamperage depending upon the application. As the electron stream 109 strikes the anode, x-rays will be produced. Those x-rays may, depending upon their energy, have both therapeutic and commercial/industrial application.

While the present embodiments of an x-ray apparatus have been illustrated using a field emission element movable with respect to a shield assembly held stationary, it will be understood that embodiments utilizing a field emission element held stationary and a field emission element movable respect to the field emission element are within the scope of the disclosures herein. Such embodiments may require more complex structures, however.

In a preferred embodiment the operating voltage is stable and the current is allowed to fluctuate somewhat. In some applications it may be desired to stabilize the operating current l by changing the operating voltage. In this case the dose delivered to the treatment target may be calculated as described below.

The radiation dose rate DR delivered to a reference point in the radiation field created by the apparatus 12 generally is defined by the formula:

$$DR=K(V)\times l, \tag{1}$$

where l is the operating current; and

K(V) is a coefficient of proportionality.

The value of K(V) depends on the operating voltage V and the distance and angular position of the point in the radiation field relative to the x-ray source. Usually, a reference point is selected on the treatment target to control the delivery of the dose. The radiation dose D(t) that is delivered to the reference point from the start of treatment to a present time depends only on the voltage and is an integral of the dose rate overtime:

$$D(t)=\int DR\times dt=\int K(V)\times l\times dt \tag{2}$$

If a sampling time in the computer is selected to be Δt and the value of l is a known constant, then the accumulated dose D(t) at the reference point can be computed as follows:

$$D(t)=l\times\Delta t\times\Sigma K(V). \tag{3}$$

Figure 10:
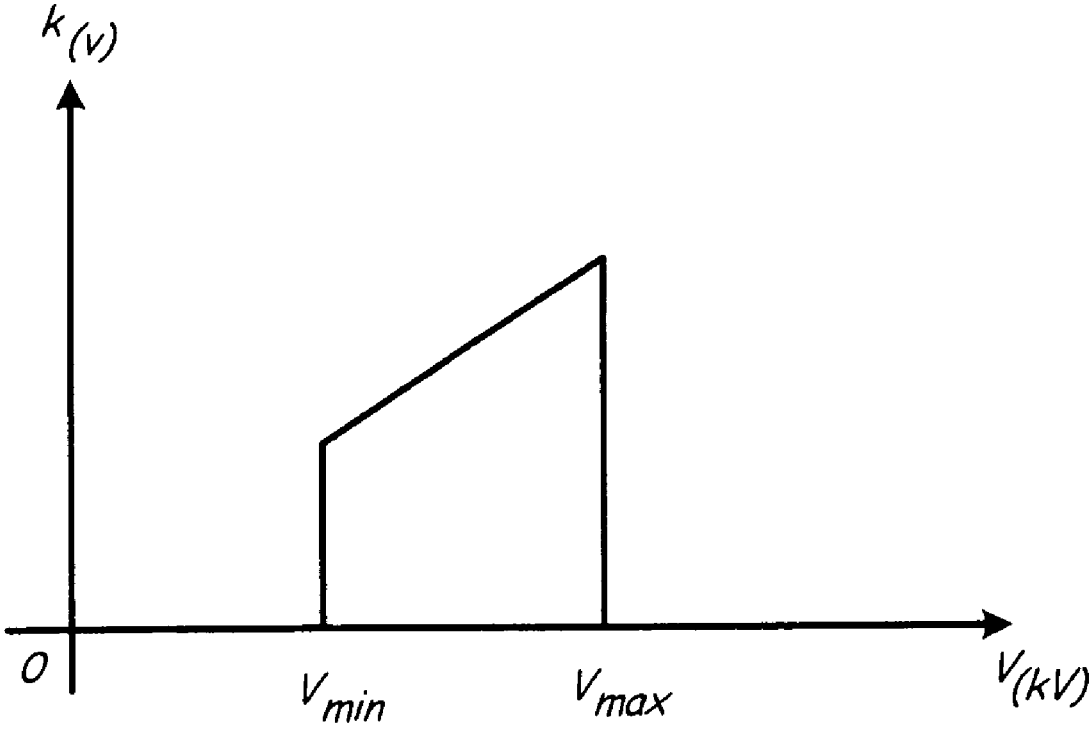
FIG. 10 illustrates a graph illustrating the relationship between the voltage provided to the x-ray apparatus by the high voltage generator and the coefficient of proportionality K(V) as described herein.

Here ΣK(V) is the total sum of all coefficients K(V) computed for each sampling time. Every sampling of information about the operating voltage V is delivered to the computer, such as computer 20, which in turn computes the value of K(V) and the sum ΣK(V). The function K(V) is a tabulated function measured during tests of the x-ray system and stored in the computer memory. This function is very close to a linear dependence and is shown in FIG. 10. During treatment the computer 20 continuously computes the accumulated dose D(t) and when the dose reaches a designated value, the computer system 20 can be programmed to stop treatment and turn off the x-ray system.

As noted, the present disclosures find use in providing therapeutic benefits. For example, the presently disclosed embodiments may find use in brachytherapy, that is, electronic radiation therapy, for breast cancer, amongst other uses. In such a use a tumor will be excised, typically with some margin of surrounding breast tissue, leaving a cavity in the breast. Typically, the cavity will be expanded using an appliance of a type known in the art and an embodiment of an x-ray apparatus disclosed herein will be positioned such that the distal probe end 56 is disposed within the cavity at a desired position. To provide precision control of the application of x-rays to the breast tissue the x-ray apparatus will preferably be held within a supporting mechanical frame that enables the operator to translate the apparatus in three dimensions and also rotate it. A predetermined therapy session can then be initiated by operator utilizing the computer system 20.

In an embodiment for use in breast cancer brachytherapy, the field emission element 104 may have a diameter in the range of about 0.1 to about 0.3 millimeters and a length in the range of about 1 millimeter to about 10 millimeters and includes 200-600 fibers each approximately 7 micrometers in diameter. Other embodiments may include a different number of fibers outside the range given above depending upon the current needs of a particular use or application. Additional fibers provide additional current and reduce fluctuations of the total current.

In an alternative embodiment of an x-ray apparatus in accord with the disclosures herein, the shield or cylindrical electrode 122 may be operated at a higher negative voltage than the cathode 96. Operating the cylindrical electrode 122 at a higher voltage will provide electrostatic focusing of the electron beam, thus reducing the dispersion or spreading of the electron beam 109, and therefore will lower the probability for flashover discharge on the dielectric (quartz) surface of the insulating members 124 and 126. In this embodiment the shield 122 is not connected to the cathode high voltage source 18 but is connected to its own high voltage power supply and feedthrough. Such alternative embodiments are within the scope of the present disclosures and claims submitted herewith.

Figure 11:
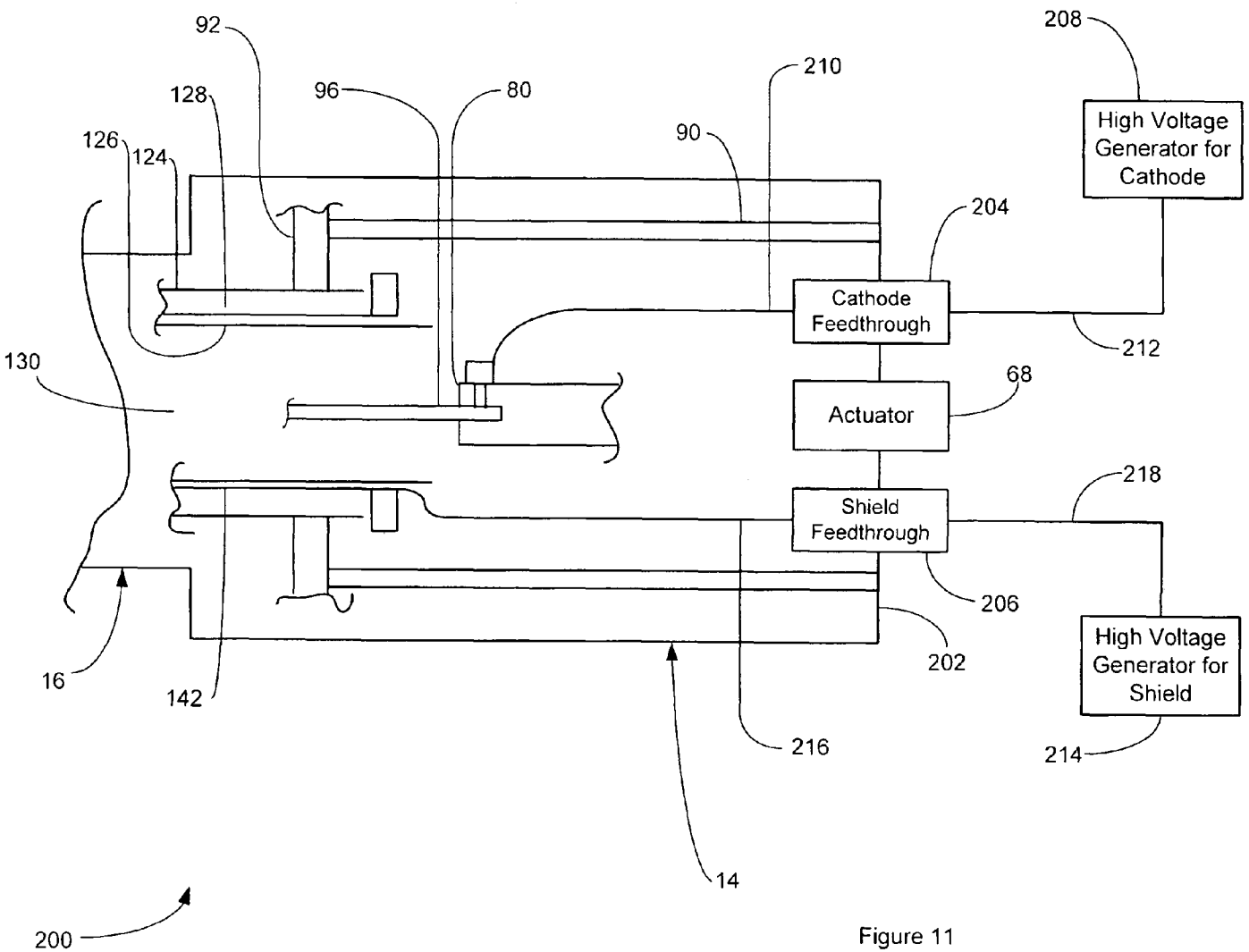
FIG. 11 illustrates an alternative embodiment in accord with the disclosures herein wherein the shield assembly and cathode are connected to separate high voltage sources.

Thus, in accord with the disclosures herein and referring now to FIG. 11, an alternative embodiment 200 of a field emission x-ray apparatus is shown. The apparatus 200 shown in the Figure has been simplified for purposes of clarity and omits some of the features shown in FIGS. 4*a*-8. Thus, apparatus 200 is shown schematically. Apparatus 200 includes a housing 14 and probe 16. A cathode 96 is supported by a cathode holder 80 as shown in the embodiment of FIGS. 4*a* and 4*b*. A shield assembly 120 comprising a pair of concentric cylindrical insulating members or tubes 124 and 126 separated by a gap 128 and disposed substantially coaxially about the cathode 96 is also shown. A hollow space 130 inside the inner member 126 is appropriately configured to receive the cathode 96. As with the embodiment of FIG. 4*a*, the outer tubular member 124 is supported by an insulating annular support disk 92 attached to the ends of support rods 90 by any known suitable manner, including threaded rod ends and screws (or brazing, adhesives, etc.) As noted, disk 92 is annular and thus includes a centrally disposed through hole 94.

Housing 14 also includes an end cap 202, which supports an actuator 68, a cathode feedthrough 204, and a shield feed through 206. The cathode 96 is electrically connected to a cathode high voltage generator 208 via electrical connector 210, cathode feedthrough 204 and electrical connector 212. Shield assembly 120 is electrically connected to a shield high voltage generator 214 via an electrical connector 216, shield feethrough 206 and electrical connector 218.

It will be understood that the embodiment illustrated in FIG. 11 would function equally well with either embodiment of the shield assembly 120 of FIGS. 5*a* and 5*b* as well as with the use of the external coil 162 or 168 shown in FIG. 6.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

The above description and associated figures teach the best mode of the invention. The following claims specify the scope of the invention. Note that some aspects of the best mode may not fall within the scope of the invention as specified by the claims. Those skilled in the art will appreciate that the features described above can be combined in various ways to form multiple variations of the invention. For example, but limited to, method steps can be interchanged without departing from the scope of the invention. As a result, the invention is not limited to the specific embodiments described above, but only by the following claims and their equivalents.

What is claimed is:

1. X-ray field emission apparatus comprising:

a high voltage generator;

a hollow probe held at vacuum;

a cathode enclosed within the probe, said cathode producing an electron stream when connected to the high voltage generator;

an anode enclosed within the probe and separated from the cathode by a gap, said anode providing a target for the electron stream; and a shield assembly comprising a hollow shield electrode positioned within the probe and about the cathode, and inner and outer non-conductive tubes, wherein each of said tubes includes a proximal and a distal tube end and said distal tube ends of said non-conductive tubes are joined together such that said inner and outer tubes are separated by a shield electrode gap, and said shield electrode is disposed within said shield electrode gap.

2. The apparatus of claim 1 wherein said shield electrode comprises a metal tube.

3. The apparatus of claim 1 wherein said each of said non-conductive tubes includes an electrode gap surface facing said shield electrode gap and said shield electrode comprises a conductive coating disposed on at least a portion of said electrode gap surfaces.

4. The apparatus of claim 1 wherein said cathode is configured as an elongate rod having proximal and distal cathode ends and further includes a field emission element disposed at said distal rod end.

5. The apparatus of claim 4 wherein said field emission element is a composite material comprising carbon fibers embedded in a conductive binder.

6. The apparatus of claim 4 wherein:

said shield assembly further comprises inner and outer non-conductive tubes, wherein each of said tubes includes a proximal and a distal tube end and said distal tube ends of said non-conductive tubes are joined together such that said inner and outer tubes are separated by a shield electrode gap;

and said shield electrode is disposed within said shield electrode gap.

7. The apparatus of claim 6 wherein said conductive element comprises a metal tube.

8. The apparatus of claim 6 wherein said each of said non-conductive tubes includes an electrode gap surface facing said shield electrode gap and said shield electrode comprises a conductive coating disposed on at least a portion of said electrode gap surfaces.

9. The apparatus of claim 1 wherein the probe includes inner and outer probe surfaces and further comprises an electromagnetic coil disposed about said outer probe surface.

10. The apparatus of claim 9 wherein said cathode is an elongate rod having proximal and distal rod ends and further includes a field emission element disposed at said distal rod end.

11. The apparatus of claim 9 wherein said field emission element is made of a composite material comprising carbon fibers embedded in a conductive binder.

12. The apparatus of claim 1 and further including a linear actuator providing axial translation of said cathode.

13. The apparatus of claim 12 wherein:

said cathode is an elongate rod having proximal and distal rod ends and further includes a field emission element disposed at said distal rod end;

said shield assembly includes a distal shield assembly end; and said linear actuator axially moves said field emission element relative to said shield assembly distal end.

14. X-ray field emission apparatus comprising:

a housing having proximal and distal housing ends;

a hollow, substantially cylindrical probe having proximal and distal probe ends, said housing and probe attached to each other and forming a single vacuum chamber;

a cathode having proximal and distal ends disposed within said single vacuum chamber and longitudinally movable with respect to said distal probe end, said cathode producing an electron beam directed towards said distal probe end when connected to a high voltage negative potential;

an anode disposed within said probe at said distal probe end, said anode and cathode separated by a gap; and a shield assembly comprising a hollow shield electrode positioned within the probe and about the cathode.

15. The apparatus of claim 14 wherein the probe includes inner and outer probe surfaces and further includes an electromagnetic coil disposed about said outer probe surface.

16. The apparatus of claim 15 wherein said cathode includes a field emission element disposed at said distal rod end.

17. The apparatus of claim 16 wherein said field emission element is made of a composite material comprising carbon fibers embedded in a conductive binder.

18. The apparatus of claim 16 wherein said shield assembly further comprises:

inner and outer non-conductive tubes, each of said tubes having a proximal and a distal end, said distal ends of said non-conductive tubes joined together, and said inner and outer tubes separated by a shield electrode gap;

wherein said hollow shield electrode is disposed within said shield electrode gap.

19. The apparatus of claim 18 wherein said conductive element comprises a metal tube.

20. The apparatus of claim 18 wherein said each of said non-conductive tubes includes an electrode gap surface facing said shield electrode gap and said conductive element comprises a conductive coating disposed on at least a portion of said electrode gap surfaces.

21. The apparatus of claim 14 wherein said shield assembly further comprises:

inner and outer non-conductive tubes, each of said tubes having a proximal and a distal end, said distal ends of said non-conductive tubes joined together, and said inner and outer tubes separated by a shield electrode gap; wherein said hollow shield electrode is disposed within said shield electrode gap.

22. The apparatus of claim 21 wherein said hollow shield electrode comprises a metal tube.

23. The apparatus of claim 21 wherein said each of said non-conductive tubes includes an electrode gap surface facing said shield electrode gap and said conductive element comprises a conductive coating disposed on at least a portion of said electrode gap surfaces.

24. The apparatus of claim 14 and further including a linear actuator for providing axial motion to said cathode.

25. X-ray field emission apparatus comprising:

a housing having proximal and distal housing ends;

a hollow, substantially cylindrical probe having proximal and distal probe ends, said housing and probe attached to each other and forming a single vacuum chamber;

a cathode having proximal and distal ends disposed within the single vacuum chamber and longitudinally movable with respect to the distal probe end, said cathode producing an electron beam directed towards said distal probe end when connected to a high voltage negative potential, said cathode being made of a soft ferromagnetic material;

an anode disposed within said probe at said distal probe end, said anode and cathode separated by a gap; and a shield assembly comprising a hollow shield electrode positioned within the probe and about the cathode.

26. The apparatus of claim 25 wherein the probe includes inner and outer probe surfaces and further includes an electromagnetic coil disposed about said outer probe surface.

27. X-ray field emission apparatus comprising:

a housing having proximal and distal housing ends;

a hollow, substantially cylindrical probe having proximal and distal probe ends, said housing and probe attached to each other and forming a single vacuum chamber;

a cathode having proximal and distal ends disposed within the single vacuum chamber and longitudinally movable with respect to the distal probe end, said cathode producing an electron beam directed towards said distal probe end when connected to a high voltage negative potential, said cathode being made of a permanently magnetized hard ferromagnetic material;

an anode disposed within said probe at said distal probe end, said anode and cathode separated by a gap; and a shield assembly comprising a hollow shield electrode positioned within the probe and about the cathode.

28. A method of operating an x-ray field emission apparatus comprising:

providing an x-ray field emission apparatus comprising:

a housing having proximal and distal housing ends;

a hollow, substantially cylindrical probe having proximal and distal probe ends, said housing and probe attached to each other and forming a single vacuum chamber;

a cathode having proximal and distal ends disposed within the single vacuum chamber and longitudinally movable with respect to the distal probe end, said cathode producing an electron beam directed towards said distal probe end when connected to a high voltage negative potential;

an anode disposed within said probe at said distal probe end, said anode and cathode separated by a gap; and a shield assembly comprising a hollow shield electrode positioned within the probe and about the cathode; and moving said cathode relative to said shield assembly to vary the current output of said anode.

29. X-ray field emission apparatus comprising:

a housing having proximal and distal housing ends;

a hollow, substantially cylindrical probe having an outer probe surface and proximal and distal probe ends, said housing and probe attached to each other;

a cathode having proximal and distal ends disposed at least partially within said probe, said cathode producing an electron beam directed towards said distal probe end when connected to a high voltage negative potential, said cathode being manufactured of a permanently magnetized material;

an anode disposed within said probe at said distal probe end, said anode and cathode separated by a gap; and a magnetic focuser for steering the electron beam towards said anode, said magnetic focuser comprising said cathode.

30. The apparatus of claim 29, further comprising a power source, and wherein said cathode is made of a soft ferromagnetic material, said apparatus further comprising a wire coil disposed about said outer probe surface, said coil being connected to said power source and generating an electromagnetic field during operation.

31. The apparatus of claim 29 further comprising a shield assembly including a hollow shield electrode disposed about said cathode and wherein magnetic focuser comprises said shield electrode being operated at a higher negative potential than said cathode such that said shield electrode functions as an electrostatic focuser.

32. X-ray field emission apparatus comprising:

a housing having proximal and distal housing ends;

a hollow, substantially cylindrical probe having proximal and distal probe ends, said housing and probe attached to each other;

a cathode having proximal and distal ends disposed at least partially within said probe, said cathode producing an electron beam directed towards said distal probe end when connected to a high voltage negative potential;

an anode disposed within said probe at said distal probe end, said anode and cathode separated by a gap;

a shield assembly comprising a hollow shield electrode positioned within the probe and about the cathode;

a cathode high voltage generator electrically connected to said cathode;

a shield assembly high voltage generator electrically connected to said shield assembly; and a magnetic focuser for steering the electron beam towards said anode, wherein said magnetic focuser comprises said shield assembly operated at a greater negative potential than said cathode.

33. X-ray field emission apparatus comprising:

a high voltage generator;

a hollow probe held at vacuum;

a cathode enclosed within the probe, said cathode producing an electron stream when connected to the high voltage generator, said cathode having proximal and distal cathode ends;

an anode enclosed within the probe and separated from said cathode by a gap, said anode providing a target for the electron stream; and a field emission element disposed at said distal cathode end wherein said field emission element is made of a composite material comprising carbon fibers embedded in a conductive binder.

* * * * *